US008202204B2

(12) United States Patent
Celone et al.

(10) Patent No.: US 8,202,204 B2
(45) Date of Patent: Jun. 19, 2012

(54) SPORTS SWINGING EXERCISE DEVICE AND METHOD

(76) Inventors: Thomas J. Celone, Reno, NV (US); Tim Yablonowski, Naples, FL (US)

( * ) Notice: Subject to any disclaimer, the term of this patent is extended or adjusted under 35 U.S.C. 154(b) by 0 days.

(21) Appl. No.: 12/843,829

(22) Filed: Jul. 26, 2010

(65) Prior Publication Data

US 2011/0183784 A1 Jul. 28, 2011

Related U.S. Application Data

(63) Continuation-in-part of application No. 10/639,236, filed on Aug. 11, 2003, now Pat. No. 7,762,929.

(51) Int. Cl.
*A63B 21/00* (2006.01)

(52) U.S. Cl. ..... 482/111; 473/228; 116/174

(58) Field of Classification Search ..... 482/111, 482/112, 148; 473/228
See application file for complete search history.

(56) References Cited

U.S. PATENT DOCUMENTS 1,306,915 A * 6/1919 Klamroth ..... 116/174
5,335,918 A * 8/1994 Rupnik et al. ..... 473/228
7,384,344 B2 * 6/2008 Aguirre ..... 473/226

* cited by examiner

*Primary Examiner* — Jerome W Donnelly
(74) *Attorney, Agent, or Firm* — James A. Italia; Italia IP

(57) ABSTRACT

A method and a device are disclosed for improving performance in sports where a swinging motion is needed. In some embodiments, a swing resistance device may be attached to or be built into elongated sport apparatus, such as racquets, clubs, bats, sticks, and the like, configured to resist a swinging motion of the sport apparatus by capturing air and utilizing a force of air resistance, similar to a parachute. The swing resistance device is generally attached to the elongated sport apparatus by coupling components that allow the swing resistance device to freely rotate around the effective longitudinal axis of the elongated sport apparatus. During a swing, air resistance creates dynamic forces that over time may improve swing power and path.

7 Claims, 4 Drawing Sheets

SPORTS SWINGING EXERCISE DEVICE AND METHOD

CROSS-REFERENCE TO RELATED APPLICATION

This application is a Continuation-in-Part of U.S. Non-Provisional application Ser. No. 10/639,236, filed Aug. 11, 2003 now U.S. Pat. No. 7,762,929, and claims the benefit of priority thereto.

TECHNICAL FIELD

This application relates generally to sports exercise. More specifically, this application relates to an exercise method and apparatus for improving performance in sports that include swinging of a device such as a club, a racket, a bat, or the like.

SUMMARY

In aspects of present disclosure, an exercise device for swing sports is disclosed including a swing resistance surface having a first end and a second end. A first coupling component is coupled to the first end and a second coupling component coupled to the second end allowing the exercise device to freely rotate about an elongated swing sport apparatus. The first coupling component and the second coupling component are configured to attach to the elongated swing sport apparatus.

In further aspects of the present disclosure, an elongated swing sport apparatus is disclosed including a shaft, a first coupling component and a second coupling component coupled with the shaft, and a swing resistance surface coupled to the first and the second coupling components and capable of freely rotating about the shaft. The swing resistance surface is configured to generate a drag force in response to a swinging motion of the elongated swing sport apparatus.

In still further aspects of the disclosure, a method of improving a swinging of an elongated swing sport apparatus is disclosed, including swinging the elongated swing sport apparatus having a swing resistance device coupled therewith. The swing resistance device includes a swing resistance surface coupled with a coupling component attached to the elongated swing sport apparatus. The swing resistance surface can freely rotate about a longitudinal axis of the elongated swing sport apparatus in response to the swinging of the elongated swing sport apparatus.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
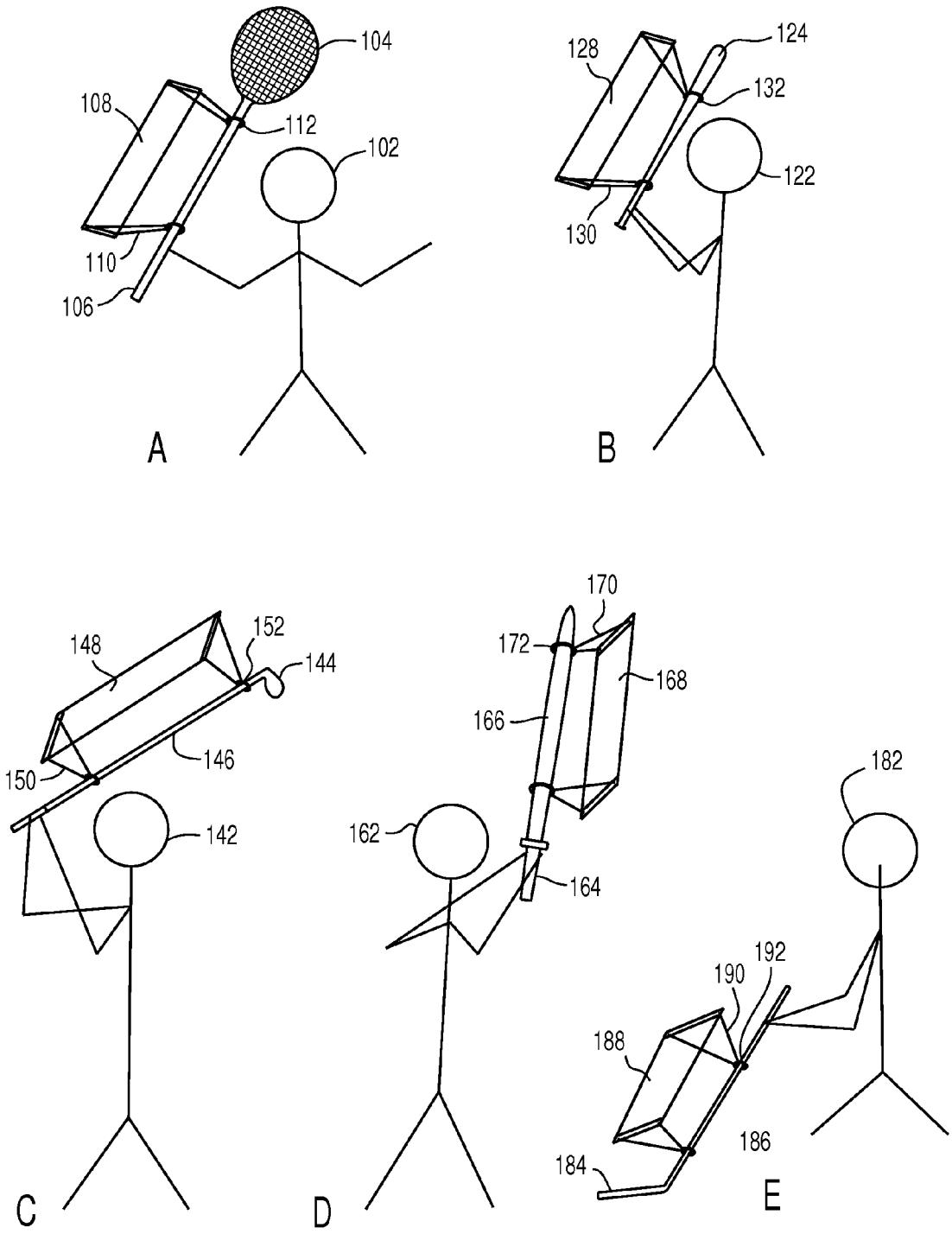
FIGS. 1A-E show example environments and sport apparatus where a swing exercise device may be used.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while following description references a limited number of sports and exercises with which the swing exercise device may be used, it will be appreciated that the disclosure may be used with other types of sports and physical activities, such as badminton, cricket, racquetball, general fitness, physical therapy, and the like.

Briefly described, a method and a device are disclosed for improving performance in sports or other physical activities where a swinging motion is needed. In some embodiments, a swing resistance device may be attached to or be built into elongated sport apparatus, such as racquets, clubs, bats, sticks, and the like, configured to resist a swinging motion of the sport apparatus by capturing air and utilizing a force of air resistance, similar to a parachute. The swing resistance device is generally attached to the elongated sport apparatus by coupling components that allow the swing resistance device to rotate around the effective longitudinal axis of the elongated sport apparatus. During a swing, air resistance pushes the swing resistance device to the back side of the elongated sport apparatus with respect to the direction of the swing, making the swing resistance device trail the elongated sport apparatus along the swing's path. This way, air resistance creates dynamic forces that over time may improve swing power and swing path, as further described below in more detail.

Many popular sports or sporting games depend on some form of sport apparatus or equipment. One of the general types of sport apparatus is elongated sport apparatus, such as racquets, clubs, bats, sticks, and the like, which are used in swing sports. Generally, in each swing sport, the elongated sport apparatus is used to hit a strike object, such as a ball, to throw the strike object towards some designated target, such as a hole, a goal, a designated area, or just far away from opponents. For example, in golf, a hole in the ground is targeted for the golf ball, while in tennis, a predetermined area of the playing field may be targeted for landing the tennis ball. The accuracy, trajectory, speed, and travel distance of the strike object mainly and directly depend on the quality of the swing of such elongated sport apparatus.

Each one of the elongated sport apparatus comes in many forms and sizes. For example, some form of racquet is used in many sports such as tennis, badminton, racquetball, squash, and the like. Similarly, some form of bat is used in various sports, such as baseball and cricket. All of these elongated sport apparatus share the common traits of being elongated and being used for a swinging action as appropriate for the sport or game. For example, a tennis racquet may be swung from behind the player towards the player's front, while a golf club is generally swung from overhead downwards. However, regardless of the relative direction of motion, swinging techniques, and other parameters, such as one-handed swing, as in tennis, and two-handed swing, as in baseball, these elongated sport apparatus are swiftly swung through the air to hit the strike object. The swift motion of the elongated sport apparatus may be substantially slowed down by a front facing surface, with respect to the direction of the motion of the swing, thus forcing the player to exert more force on the elongated sport apparatus to continue the swing at high speed.

Performance in the swing sports generally is highly dependent on the quality of the swing. When the swing does not follow a prescribed path or trajectory, is not swift enough, or does not follow a particular sequence of body movements, such as moving the hips first and then moving shoulders in golf, then the ball (or other object used in the game or sport for striking with the elongated sport apparatus) does not go to the desired target area. Thus, to improve player performance in a swing sport, a self-adjusting, swing-resisting force that naturally results from the swing motion and dynamically adjusts the direction and amount of the swing-resisting force, may be used as an effective tool.

FIGS. 1A-D show example environments and sport apparatus where a swing exercise device may be used. FIG. 1A is an example racquet sport, such as tennis or badminton, where a player 102 holds a racquet 104 having a shaft 106 to which a swing resistance surface 108 is attached via coupling links 110 and coupling components 112. Coupling links 110 are attached to coupling component 112 and configured to freely rotate about a longitudinal axis of shaft 106. In some embodiments, swing resistance surface 108 is configured to be able to rotate 360 degrees about shaft 106, while in other embodiments, swing resistance surface may be constrained to be able to rotate fewer than 360 degrees about shaft 106, for example, 180 degrees. In some embodiments, coupling component 112 is a ring, configured to enclose shaft 106, having a rotatable mechanism such as a bushing to allow rotation about shaft 106. In other embodiments, the rotatable mechanism includes a curved slot allowing coupling links 110 to rotatably slide about shaft 106, as further described below with respect to FIG. 3.

In various embodiments, swing resistance surface 108 is a light weight membrane, such as a nylon membrane, while in other embodiments, it may be a stiff or rigid light weight sheet, such as a plastic sheet. Those skilled in the art will appreciate that other types of swing resistance surfaces may be utilized without departing from the spirit of the present disclosures.

In operation, as player 102 swings racquet 104, swing resistance surface 108 is forced back by the air resistance and trails shaft 106 in the direction of the swing. The free rotation of swing resistance surface 108 about shaft 106 enables swing resistance surface 108 to dynamically adjust itself in response to the force and direction of air resistance resulting from the swing. When racquet 104 is swung with sufficient force and/or speed, a substantial force generated by swing resistance surface 108 is transmitted to and experienced by player 102 resulting in a stiffer swing, where same force applied by player 102 results in a slower but more forceful swing. This stiff swing felt by player 102 may result in two kinds of actions: one, muscles involved in the swing are worked more intensely and thus become stronger with repeated swings over time, and two, the sequence of body movements resulting in the swing is substantially optimized for maximal swing efficiency and optimal swing path traversal, as further described below.

Using the swing resistance device, the sequence of player's body movements resulting in the swing is substantially optimized because encountering extra resistance at every point in the path of the swing, the body seeks to find the path and sequence of motions that encounter the least resistance, and/or find a sequence of motion during which the player's body can more effectively exert force without losing balance. For example, in a tennis forehand swing, optimally, the hips move ahead of the shoulders followed by the swinging arm. This sequence provides maximum power to the tennis racquet, each group of muscles working in tandem and building upon the work of the muscles in the previous muscle group and/or part of the sequence. If the arm swings ahead of its proper sequence, player feels out of balance due to exerted forces and cannot deliver maximum power to the racquet. When the sequence is correct, the player can exert more force on the racquet. Thus the player automatically feels the corrective forces of swing resistance device and adjusts his movements accordingly to optimize the power he can deliver to the sport apparatus, in this case, the racquet. Additionally, stray lateral movements that do not contribute to the swing are discouraged because every lateral movement also causes a resistance in the opposite direction tending to imbalance the player. Thus, the swing becomes "clean" and follows the desired path and results in substantially optimal swing path traversal. The player's body and its muscle memory automatically learn the lowest path of resistance resulting in optimized swings. In effect, the dynamic resistive forces generated by the swing resistance surface provide an effective feedback for the player's body to adjust its sequence of motion and the swing path.

FIGS. 1B-D show additional example sports that use elongated sport apparatus.

FIG. 1B shows a baseball player 122 handling a bat 124 having a swing resistance surface 128 coupled with bat 124 via coupling links 130 and coupling components 132.

FIG. 1C shows a golf player 142 handling a golf club 144 having a swing resistance surface 148 coupled with golf club 144 via coupling links 150 and coupling components 152.

FIG. 1D shows a Kendo (Japanese stick-sword fighting sport) player 162 handling a stick 164 having a shaft 166 coupled with a swing resistance surface 168 via coupling links 170 and coupling components 172.

Figure 2:
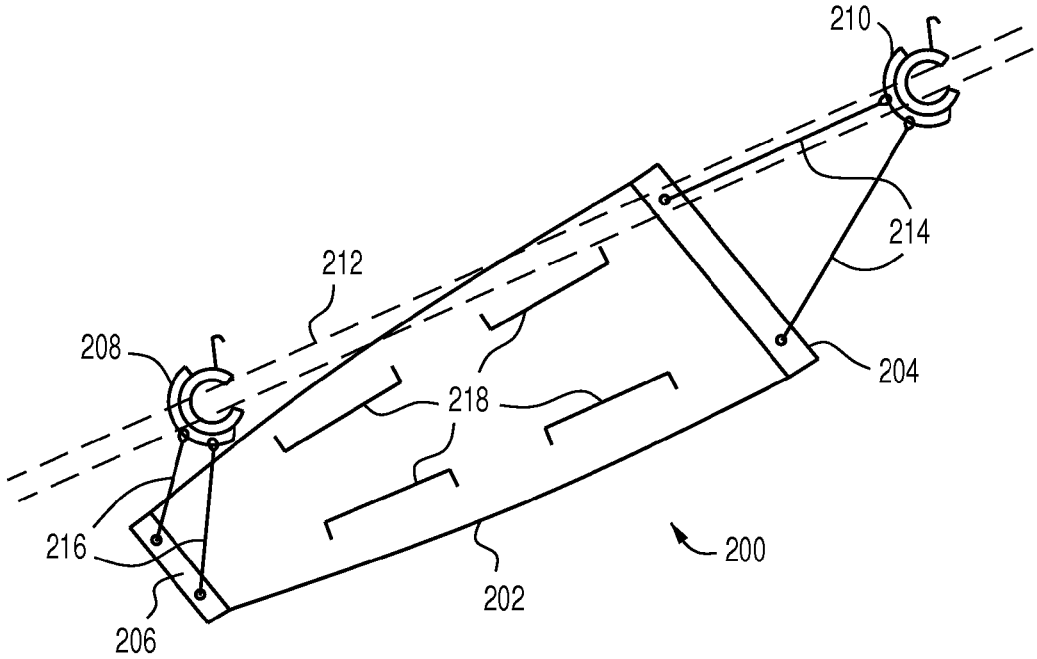
FIG. 2 is an example swing exercise device as used in FIGS. 1A-D.

FIG. 2 is an example swing exercise device as used in FIGS. 1A-D. Swing exercise device 200 includes a swing resistance surface 202, flaps 218, stiffener elements 204 and 206, coupling links 214 and 216, and shaft coupling components 208 and 210. Shaft coupling components 208 and 210 are generally coupled with shaft 212 of elongated sport apparatus. In some embodiments, swing resistance surface 202 is directly coupled to the coupling components 208 and 210, without using intermediate coupling links. In various embodiments, swing resistance surface 202 is tapered from a first broader end to a second narrower end, each terminated in a corresponding stiffener element. In other embodiments, swing resistance surface 202 is substantially rectangular. In still other embodiments, swing resistance surface 202 has other shapes, such as oval, triangular or irregular.

In some embodiments, swing resistance surface 202 is configured to provide different amounts of resistance at different points along the shaft of the elongated sport apparatus. For example, if more resistance is needed at the tip of the elongated sport apparatus farthest from the player's hand, then the swing resistance surface is made broader near the tip to produce more drag. Stiffeners 204 and 206 are used to maintain swing resistance surface 202 in an open configuration to maximize drag. In various embodiments, coupling links 214 and 216 are made of cables, such as steel or nylon cables, while in other embodiments, coupling links 214 and 216 are made of rigid wires. Coupling links 214 and 216 are attached to coupling components 208 and 210 in a configuration that enables free rotation of swing resistance surface 202 about the longitudinal axis of shaft 212.

In some embodiments, flaps 218 may be provided that may be opened to let air through during a swing and reduce air resistance. Such flaps may be useful for adjusting the amount of resistance desired. Various known mechanisms, such as Velcro fasteners, zippers, and the like, may be used to close or open flaps 218.

In various embodiments, swing exercise device 200 may be built into the elongated sport apparatus designed especially for swing exercise. In such embodiments, coupling components 208 and 210 may be permanently fixed to shaft 212, eliminating the necessity of attaching the coupling components to the shaft and adjusting the distances between the coupling components, firmness of attachment and other such overhead.

Figure 3A:
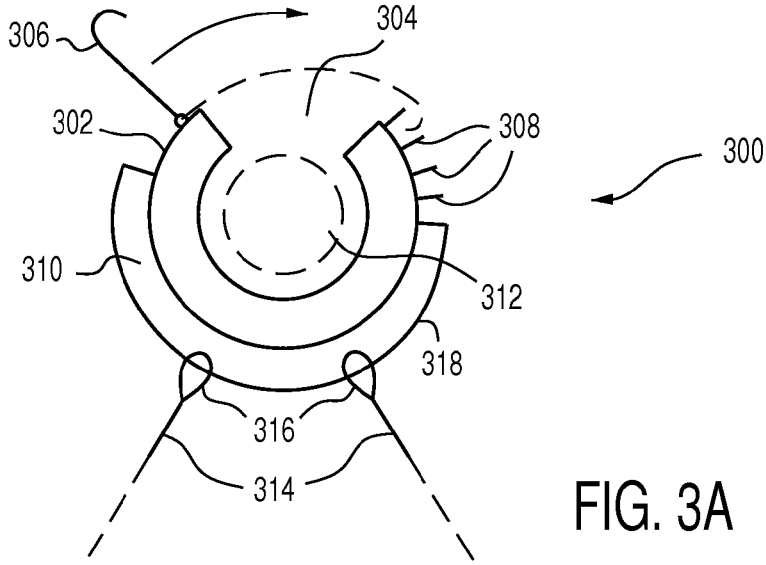
FIG. 3 is an example coupling component of the swing exercise device usable to attach the swing exercise device to the elongated sport apparatus.
Figure 3B:
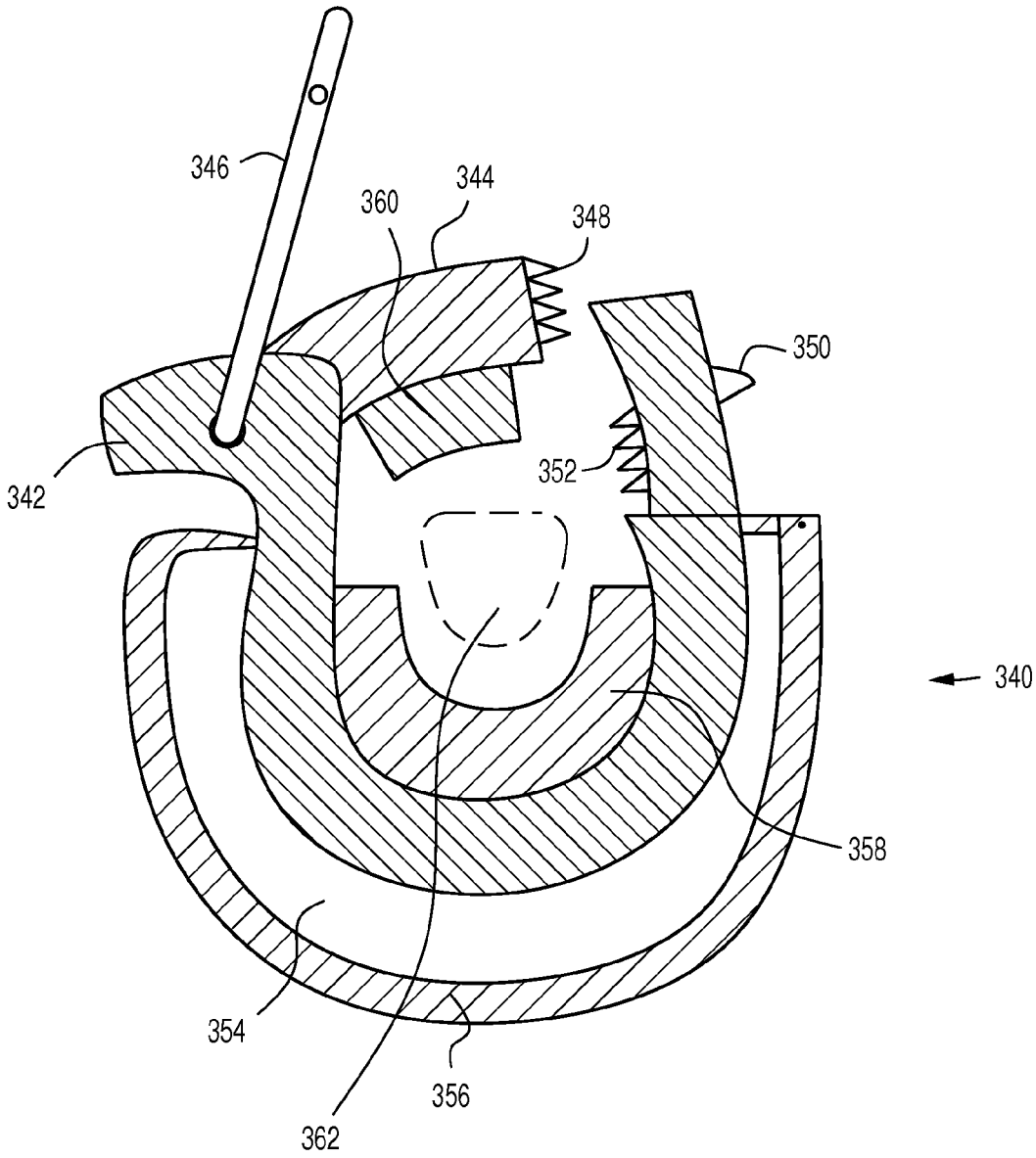

FIG. 3 is an example coupling component of the swing exercise device usable to attach the swing exercise device to the elongated sport apparatus. In various embodiments, coupling component 300 includes an inner ring 302 having an opening 304 is configured to enclose a shaft 312 of an elongated sport apparatus, such as a club or a bat. A latch 306 attached to inner ring 302 is configured to lock inner ring 302 around shaft 312 by hooking or otherwise attaching to lugs 308. Multiple lugs 308 may be used to provide various degrees of tightness of inner ring 302 around shaft 312. A curved slot 310 is created between inner ring 302 and outer ring 318 where loops 316 of coupling links 314 are deployed. Curved slot 310, in effect, creates a rotation path for the swing resistance surface about shaft 312. Coupling links 314 are configured to slide freely along curved slot 310 via loops 316. In some embodiments, inner ring 302 is made of supple and elastic material such as firm rubber to allow a firm grip on shaft 312 without substantial slippage during a fast swing action. Those skilled in the art will appreciate that many other fastening and locking methods may be devised for wrapping coupling components or rings around a shaft without departing from the spirit of the present disclosures.

In other embodiments, coupling component 300 may include a bushing between an inner ring and an outer ring to allow rotation about the shaft. In still other embodiments, and inner ring and an outer ring may be coupled together with bearings to minimize any friction during rotation of the swing exercise device.

Figure 4:
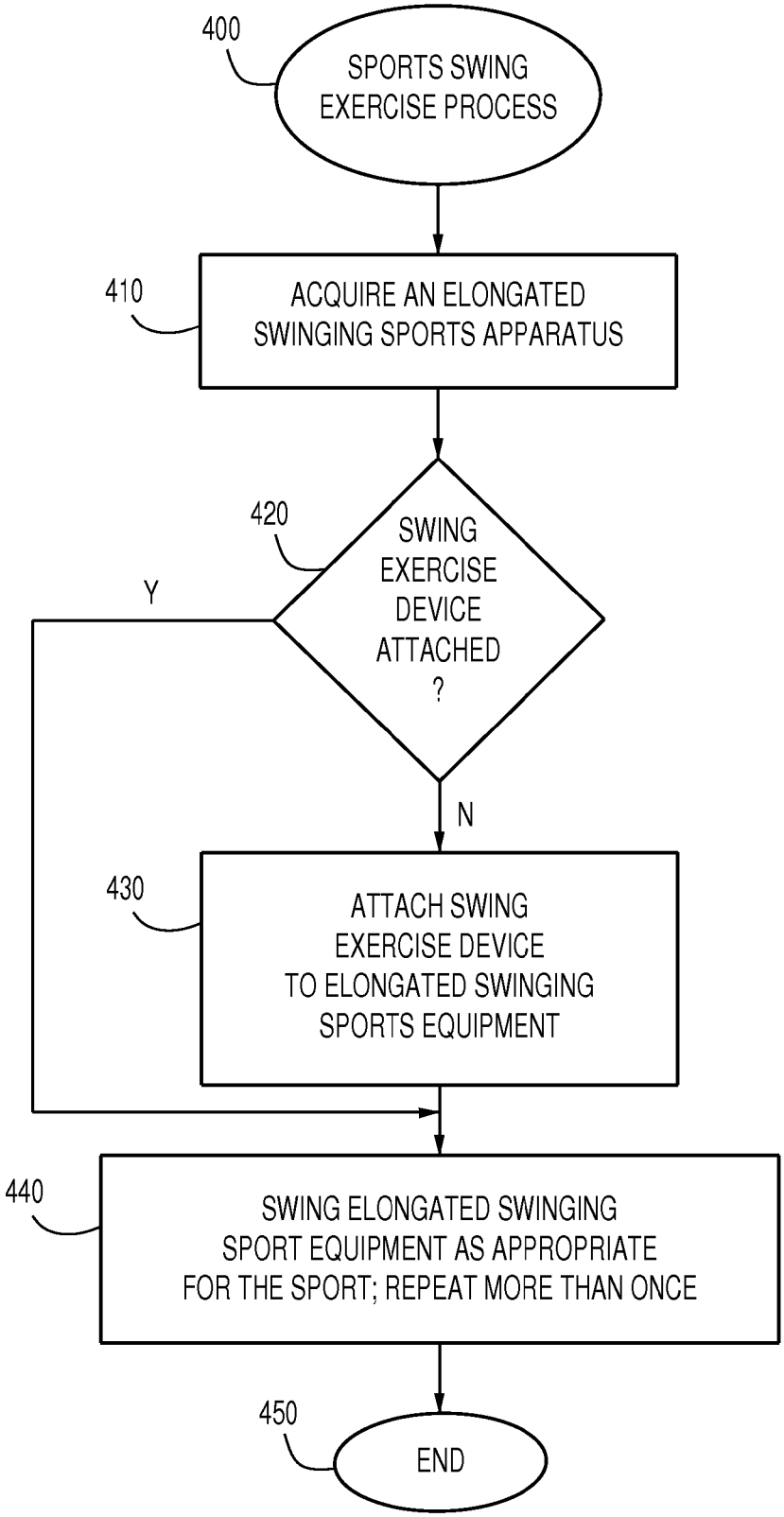
FIG. 4 is a flow diagram showing an example process of using the swing exercise device with elongated sport apparatus.

FIG. 4 is a flow diagram showing an example process of using the swing exercise device with sport apparatus. The swing exercise process 400 proceeds to block 410 where an elongated swing sport apparatus is obtained to begin swinging exercise. The process proceeds to block 420.

At block 420, it is ascertained whether the elongated swing sport apparatus has a swing exercise device attached. If so, the process proceeds to block 440, otherwise, at block 430 a swing exercise device is attached to the elongated swing sport apparatus using coupling components, such as the one described with respect to FIG. 3. The process proceeds to block 440.

At block 440, the elongated swing sport apparatus, for example, a club or a bat, is swung by a player or user in accordance with the techniques customary and appropriate for the corresponding sport or game. Repetition of this step over time may improve muscle tone, swing motion coordination, body movement sequencing, and swing path traversal, as previously described.

Next, the process proceeds to block 450 and terminates.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. An exercise device for swing sports, the exercise device comprising:

a swing resistance surface having a first end and a second end; and a first coupling component rotatably coupled to the first end and a second coupling component rotatably coupled to the second end, wherein the first coupling component and the second coupling component are configured to attach to an elongated swing sport apparatus, wherein each of the first and the second coupling components comprises an inner ring with an opening and an outer ring, which forms a curved slot between the inner ring and the outer ring.

2. The exercise device of claim 1, wherein the curved slot is configured to provide a rotation path for the swing resistance surface.

3. An elongated swing sport apparatus comprising:

a shaft;

a first coupling component and a second coupling component coupled with the shaft;

a swing resistance surface rotatably coupled to the first and the second coupling components wherein the swing resistance surface is configured to generate a drag force in response to a swinging motion of the elongated swing sport apparatus; and a first stiffener element coupled to a first end of the swing resistance surface and a second stiffener element coupled to a second end of the swing resistance surface.

4. The elongated swing sport apparatus of claim 3, further comprising a first coupling link connected between the first coupling component and the first end and a second coupling link connected between the second coupling component and the second end.

5. An elongated swing sport apparatus comprising:

a shaft;

a first coupling component and a second coupling component coupled with the shaft; and a swing resistance surface rotatably coupled to the first and the second coupling components wherein the swing resistance surface is configured to generate a drag force in response to a swinging motion of the elongated swing sport apparatus, wherein each of the first and the second coupling components comprises an inner ring with an opening and an outer ring, which forms a curved slot between the inner ring and the outer ring.

6. The elongated swing sport apparatus of claim 5, wherein the curved slot is configured to provide a rotation path for the swing resistance surface to rotate about the shaft.

7. An elongated swing sport apparatus comprising:

a shaft;

a first coupling component and a second coupling component coupled with the shaft; and a swing resistance surface rotatably coupled to the first and the second coupling components, wherein the swing resistance surface is configured to generate a drag force in response to a swinging motion of the elongated swing sport apparatus, wherein each of the first and the second coupling components comprises an inner ring with an opening and an outer ring coupled with the inner ring by a bushing.

* * * * *